US010998613B2

(12) United States Patent
Park et al.

(10) Patent No.: US 10,998,613 B2
(45) Date of Patent: May 4, 2021

(54) CHIP ANTENNA

(71) Applicant: WITS Co., Ltd., Yongin-si (KR)

(72) Inventors: Sung Jun Park, Suwon-si (KR); Ha Ryong Hong, Suwon-si (KR); Sung Eun Cho, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 739 days.

(21) Appl. No.: 15/795,991

(22) Filed: Oct. 27, 2017

(65) Prior Publication Data

US 2018/0277926 A1 Sep. 27, 2018

(30) Foreign Application Priority Data

Mar. 23, 2017 (KR) ..... 10-2017-0036658
Jul. 6, 2017 (KR) ..... 10-2017-0086057

(51) Int. Cl.

| | |
|---|---|
| ***H01Q 1/22*** | (2006.01) |
| ***H01Q 11/08*** | (2006.01) |
| ***H01Q 1/36*** | (2006.01) |
| ***H01Q 1/40*** | (2006.01) |
| ***H01Q 7/08*** | (2006.01) |
| ***H01F 27/29*** | (2006.01) |
| ***H01F 27/30*** | (2006.01) |
| ***H01F 27/28*** | (2006.01) |
| ***H01F 17/04*** | (2006.01) |
| ***H01Q 7/06*** | (2006.01) |
| ***H01F 27/02*** | (2006.01) |

(52) U.S. Cl.

CPC ..... *H01Q 1/2283* (2013.01); *H01F 17/045* (2013.01); *H01F 27/2828* (2013.01); *H01F 27/292* (2013.01); *H01F 27/306* (2013.01); *H01Q 1/362* (2013.01); *H01Q 1/40* (2013.01); *H01Q 7/06* (2013.01); *H01Q 7/08* (2013.01); *H01Q 11/08* (2013.01); *H01F 27/022* (2013.01)

(58) Field of Classification Search

CPC ..... H01Q 1/2283; H01Q 7/08; H01F 17/045
See application file for complete search history.

(56) References Cited

FOREIGN PATENT DOCUMENTS

| | | | |
|---|---|---|---|
| CN | 1154127 | C | 6/2004 |
| CN | 101859637 | A | 10/2010 |
| CN | 102097200 | A | 6/2011 |
| CN | 103578740 | A | 2/2014 |
| CN | 105006627 | A | 10/2015 |
| JP | 7-230914 | A | 8/1995 |
| JP | 10-064737 | A | 3/1998 |
| JP | 2006-253394 | A | 9/2006 |
| JP | 2011119379 | A | 6/2011 |
| KR | 10-2016-0136488 | A | 11/2016 |

OTHER PUBLICATIONS

Chinese Office Action dated Nov. 29, 2019 issued in corresponding Chinese Patent Application No. 201711431227.1.
Korean Office Action dated Aug. 20, 2018, in corresponding Korean Application No. 10-2017-0086057 (6 pages in English, 6 pages in Korean).

*Primary Examiner* — Graham P Smith
*Assistant Examiner* — Amal Patel
(74) *Attorney, Agent, or Firm* — Harness, Dickey & Pierce, P.L.C.

(57) ABSTRACT

A chip antenna includes a coil; and a core including a body portion around which the coil is wound and supporting portions disposed on both sides of the body portion, wherein the core includes a second groove formed in the supporting portions and accommodating an end portion of the coil.

15 Claims, 11 Drawing Sheets

I – I'

II-II'

III-III'

CHIP ANTENNA

CROSS-REFERENCE TO RELATED APPLICATION(S)

This application claims priority to Korean Patent Application Nos. 10-2017-0036658 filed on Mar. 23, 2017, and 10-2017-0086057 filed on Jul. 6, 2017, in the Korean Intellectual Property Office (KIPO), the disclosures of which are incorporated herein by reference in their entirety.

BACKGROUND

1. Field

The present disclosure relates to a chip antenna.

2. Description of Related Art

Mobile communications terminals such as cellular phones, personal digital assistants (PDAs), navigation devices, notebook PCs, and the like, supporting wireless communications, perform operations such as code division multiple access (CDMA), wireless LAN, digital multimedia broadcasting (DMB), near field communication (NFC), and the. An antenna included in the communications terminal permits these operations.

A chip antenna is a type of antenna, and is directly mounted on a surface of a circuit board to perform an antenna function.

Such an antenna may be classified as a chip antenna of which patterns are stacked in a ceramic body, or as a solenoid type chip antenna in which a coil is wound around an outer surface of a core.

SUMMARY

An aspect of the present disclosure may provide a solenoid-type chip antenna capable of being mounted on a board and having an improved connection bond between the chip antenna and the board.

According to an aspect of the present disclosure, a chip antenna may include a coil; and a core including a body portion around which the coil is wound and support members, each disposed on opposite ends of the body portion, wherein the core includes a first groove in each support member, the first groove being to receive an end of the coil.

According to another aspect of the present disclosure, a chip antenna may include a coil; and a core including a body portion around which the coil is wound and supporting portions disposed on opposite ends of the body portion, wherein the core includes a first groove defined on a bottom surface of each support member, and a leading portion of the coil is received in the supporting portions through the first groove.

BRIEF DESCRIPTION OF DRAWINGS

The accompanying drawings, which are included to provide further understanding and are incorporated in and constitute apart of this specification, illustrate disclosed embodiments and together with the description serve to explain the principles of the disclosed embodiments. In the drawings.

DETAILED DESCRIPTION

Hereinafter, exemplary embodiments of the present disclosure will now be described in detail with reference to the accompanying drawings.

A chip antenna described herein may perform at least one function of radio frequency identification (RFID), near field communication (NFC), wireless power transfer (WPT), and magnetic secure transmission (MST).

The chip antenna may be used in an electronic device configured to transmit or receive a radio signal. For example, the chip antenna may be used in a portable telephone, a portable notebook, a drone, and the like.

Figure 1:
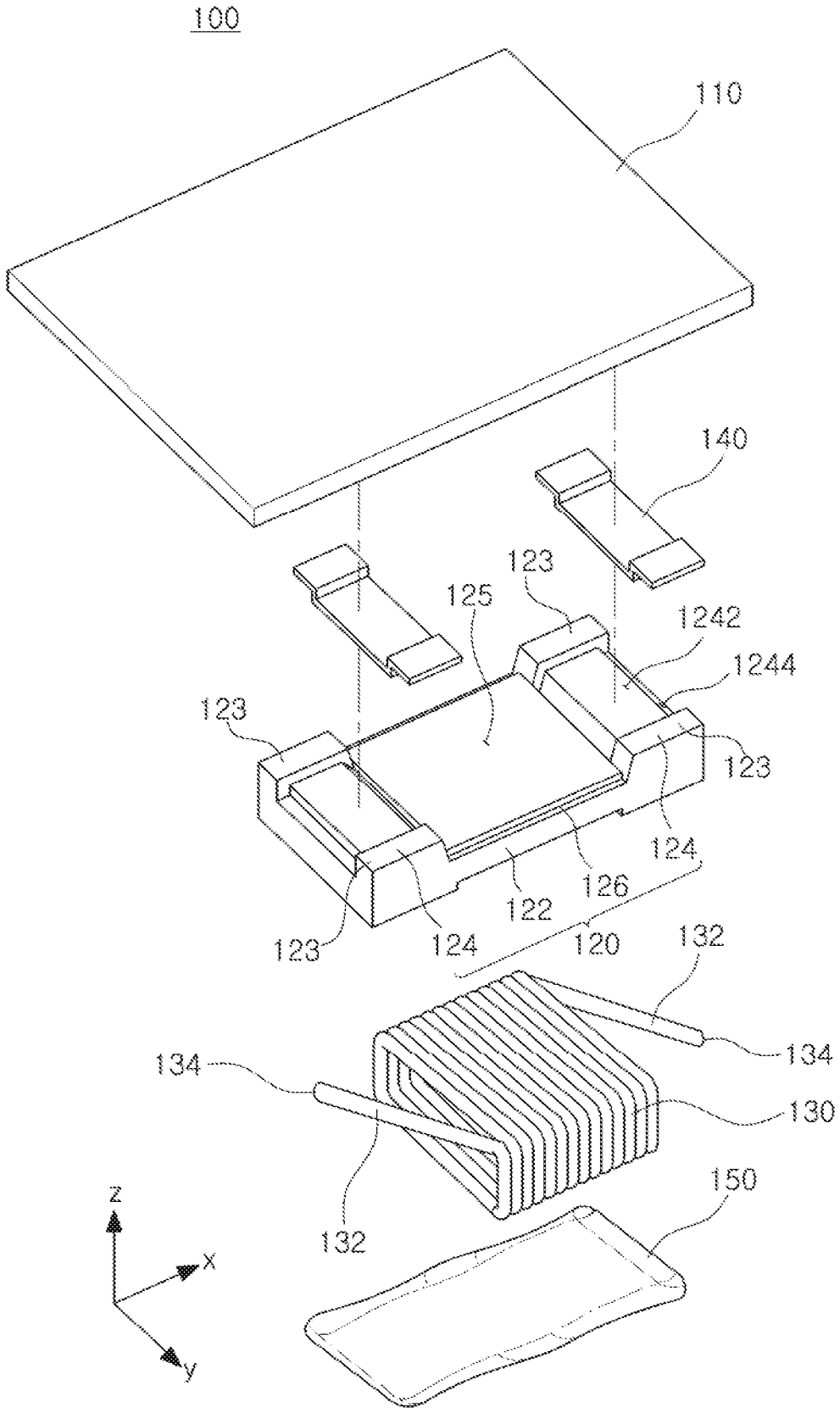
FIG. 1 is a perspective view of a chip antenna in an unassembled state according to an exemplary embodiment in the present disclosure.
Figure 2:
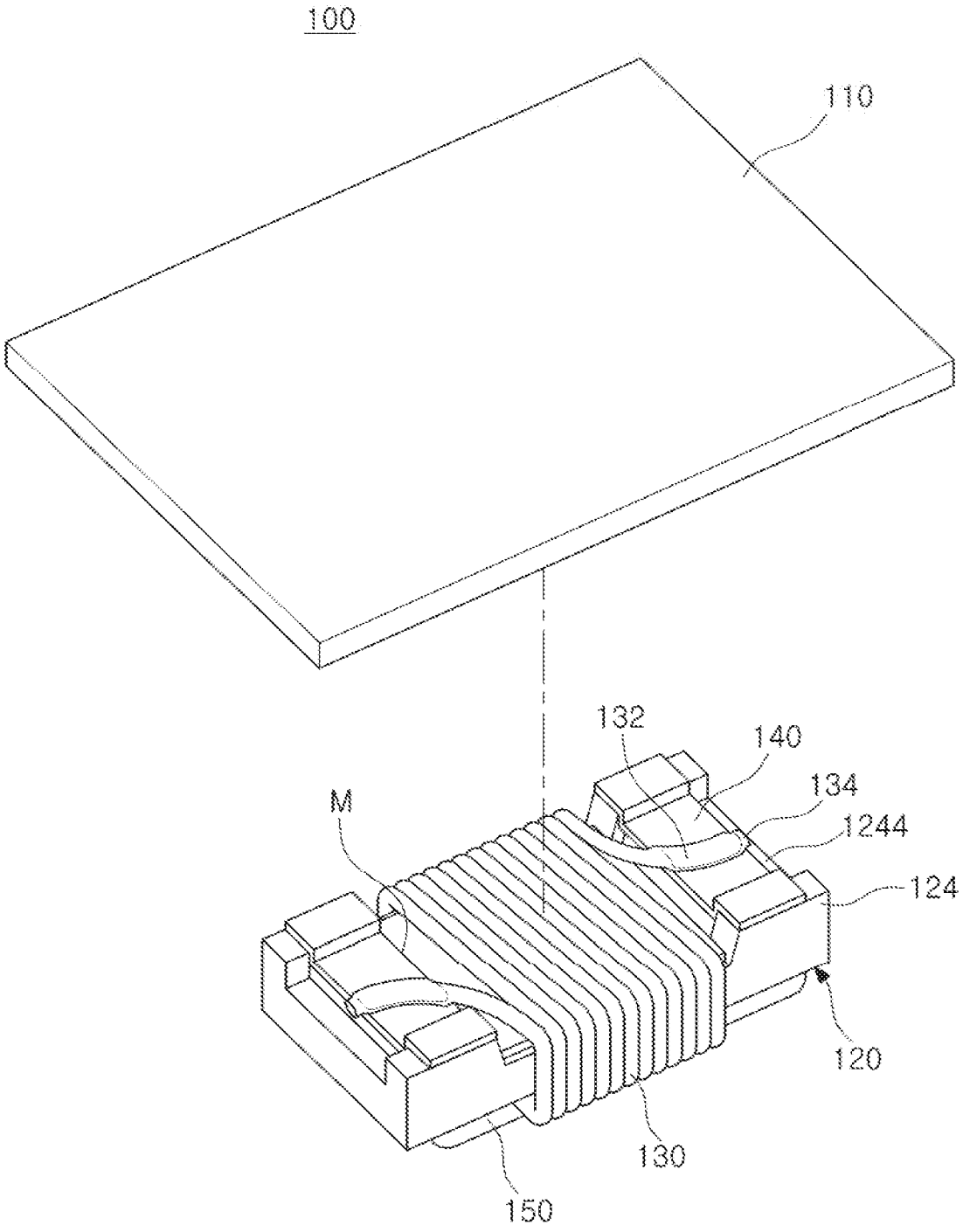
FIG. 2 is a perspective view of the chip antenna of FIG. 1 in a partially assembled state.
Figure 3:
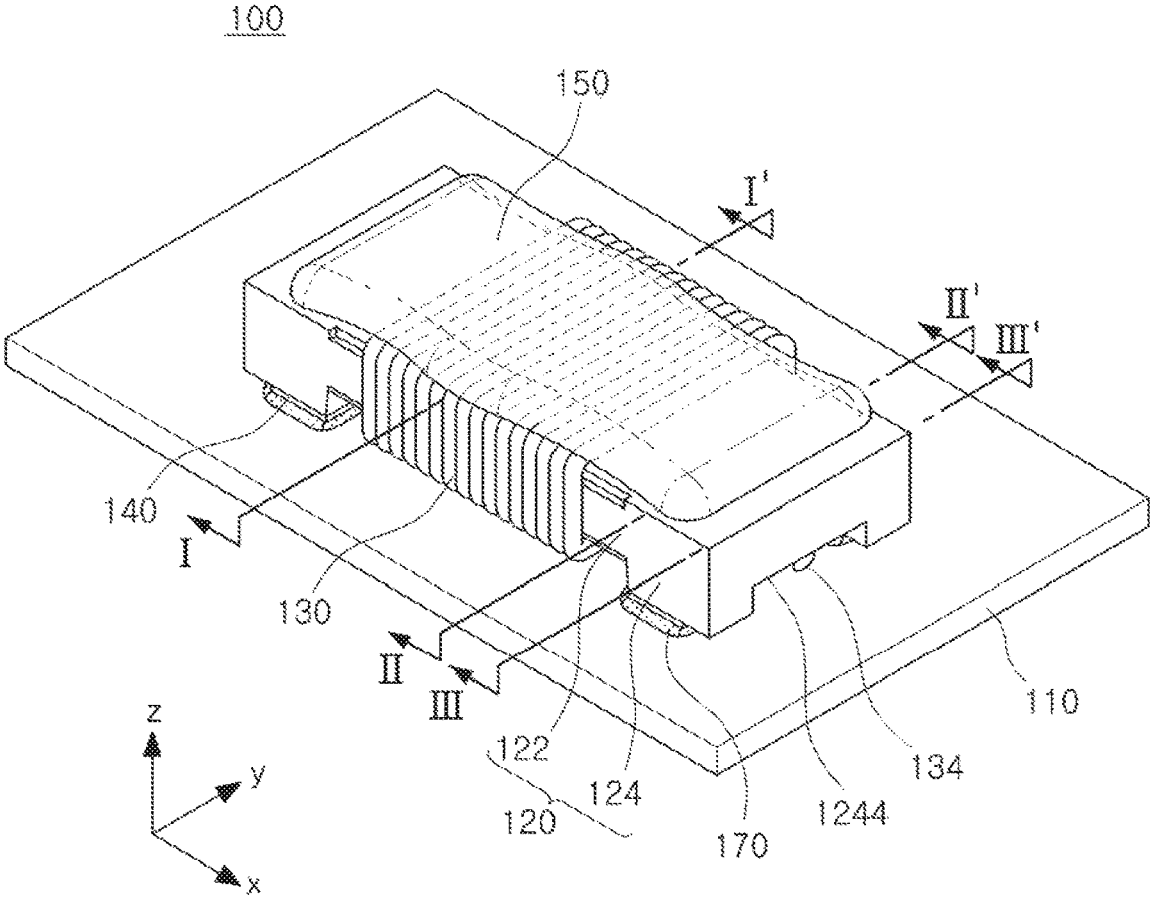
FIG. 3 is a perspective view of the chip antenna illustrated in FIG. 1 in an assembled state.

FIG. 1 is a perspective view of a chip antenna 100 in an unassembled state according to an exemplary embodiment in the present disclosure, FIG. 2 is a perspective view of the chip antenna 100 in a partially assembled state, and FIG. 3 is a perspective view of the chip antenna 100 as assembled. For the sake of illustration, FIGS. 1 and 2 illustrate a bottom portion of the components included in the chip antenna 100, while FIG. 3 illustrates the top portion of the components.

Referring to FIGS. 1-3, the chip antenna 100 may be mounted on a board 110, and may include a core 120 and a coil 130. However, the configurations of the chip antenna 100 are not limited to the components described above. For example, the chip antenna 100 may further include a pad 140 and a protective resin 150.

The board 110 may be a circuit board on which circuits or electronic components required by a wireless antenna are mounted. For example, the board 110 may be a printed circuit board (PCB) including on which one or more electronic components, which may either be mounted (or otherwise installed) on a surface thereof or are embedded (or otherwise installed) in the PCB. Circuits that electrically connect the electronic components with each other may be printed on the board 110. However, the electronic component(s) are not necessarily embedded in or mounted on the board 110. For example, in order to miniaturize the board 110 and/or make the board 110 more thinner, the electronic component may not be mounted on the surface of the board 110.

The core 120 may be or include a ferrite material or a ferrite mixed material. For example, the core 120 may be formed by sintering a ferrite powder, or may be formed by injection molding a resin mixture including ferrite powder. As another example, the core 120 may be manufactured by pressurizing and sintering a multilayer structure of ceramic sheets having ferrite as a main component.

The core 120 may generally have a quadrangular cross section. However, the shape of the core 120 is not limited to the above-mentioned shape. For example, the core 120 may be changed to various shapes such as a cylindrical shape, and the like, as needed.

The core 120 may include a body portion 122 and a supporting portion 124. For example, a central portion of the core 120 may be the body portion 122, and the supporting portion 124 may be disposed at each longitudinal end (X-direction) of the body portion 122.

The body portion 122 may be configured such that the coil 130 may be wound on the body portion 122. For example, the body portion 122 may generally have a shape of a rectangular parallelepiped having a rectangular cross section and may be configured such that the coil 130 may be wound thereon in a central portion thereof. Chamfered edges 126 may be defined in the body portion 122 on longitudinally opposite edges in the central portion of the core 120 and on top and bottom surfaces of the core 120 (See FIG. 4) and the chamfered edges 126 may extend longitudinally along a length (X-direction on FIG. 3) of the body portion 122 between two longitudinally opposite supporting portions 124. The chamfered edges 126 may reduce a winding radius of the coil 130, which substantially decreases a total thickness of the coil 130 when wound on the core 120. In addition, the chamfered edges 126 may limit (or otherwise minimizes) bending of the coil 130 along the longitudinal edges of the core 120 and thereby limit the coil 130 from being cut or damaged at or adjacent the longitudinal edges.

The supporting portions 124 may be formed at both ends (e.g., longitudinally opposite ends) of the body portion 122, and may define a space 125 therebetween. The coil 130 may be disposed in the space 125.

In an example and as illustrated, the supports 124 may include protrusions or "legs" 123 each disposed in a corner of the core 120 and extending a certain distance from the body portion 122 such that the board 110 and the body portion 122 may not directly contact each other when the core 120 is installed on the board 110. The space 125 may be sized such that the coil 130 when wound around the body portion 122 may not contact the board 110.

The supporting portion 124 may accommodate a portion of the coil 130 therebetween. For example, a first groove 1242 and a second groove 1244 may be formed extending transversely (e.g., in the Y-direction) between adjacent legs 123 at the same longitudinal end and on a bottom surface (with reference to the orientation of the core 120 in FIG. 3) of the supporting portion 124.

The first groove 1242 may be formed between adjacent legs 123 at the same longitudinal end, and may be in the form of a recess extending between the legs 123. The second groove 1244 may be formed at the outer distal longitudinal ends of the core 120, and may be disposed at longitudinally outer ends of the first groove 1242.

The first groove 1242 may be sized or otherwise configured to accommodate a leading portion 132 of the coil 130, and the second groove 1244 may be sized or otherwise configured to accommodate an end 134 of the coil 130. For example, the first groove 1242 may be wider (e.g., measured in the Y-direction) and shallower (e.g., measured in the Z-direction) than the second groove 1244, and the second groove 1244 may be deeper (e.g., measured in the Z-direction) than the first groove 1242. More specifically, the first groove 1242 may have a depth less than a diameter of the coil 130, and for example, the depth of the first groove 1242 may be in the range of about 40% to about 60% of the diameter of the coil 130. In addition, the second groove 1244 may have a depth which is the same as or greater than the diameter of the coil 130, and for example, the depth of the second groove 1244 may be in the range of about 100% to about 120% of the diameter of the coil 130.

The coil 130 may be wound on the core 120. Most of the coil 130 may be wound on the body portion 122 of the core 120, and a portion of the coil 130 (e.g., the leading portion 132 and the end 134) may be disposed on the supporting portion 124. The coil 130 may be wound around the body portion 122 in a helical shape or a solenoid shape along a length direction (X-direction) of the body portion 122. However, the shape of the wound coil 130 is not limited thereto.

The coil 130 may be in a form of wire, but is not limited thereto. For example, the coil 130 may be of a form of flat wire (e.g., an edgewise coil, a flat type coil, a rectangular wire, and the like).

The coil 130 may be electrically connected to the board 110. For example, the leading portion 132 of the coil 130 may be disposed in the first groove 1242, and may be electrically connected to the board 110 using a conductive adhesive 170 (FIG. 3).

The leading portion 132 of the coil 130 may contact the first groove 1242 and may be bonded to the pad 140 disposed in the first groove 1242. For example, the leading portion 132 of the coil 130 may be flattened using a press-type apparatus 190 (FIG. 14) that generates a compressive force. When flattened, the leading portion 132 may be in surface-contact with the pad 140 and the leading portion 132 is flattened such that it is wider than the diameter of the coil 130.

The end 134 of the coil 130 may be disposed inside the second groove 1244 so as not to interfere with the board 110 or other nearby electronic components.

The pad 140 may be disposed on the supports 124 to electrically connect the board 110 and the coil 130 with each other.

The pad 140 may be formed by applying silver (Ag) paste to the core 120 to form a metal layer, and then a conductive layer may be formed on the metal layer. However, the formation of the pad 140 is not limited thereto. For example, the pad 140 may also be directly formed on the core 120 through a plating operation. The plating operation may be performed for one or more metal materials selected from nickel (Ni), aluminum (Al), iron (Fe), copper (Cu), titanium (Ti), chromium (Cr), gold (Au), silver (Ag), palladium (Pd), and platinum (Pt) using an electroless plating method, an electroplating method, a screen printing method, a sputtering method, an evaporation method, an ink-jetting method, a dispensing method, a combination there of and the like.

The pad 140 may be formed on a lower surface of the supporting portion 124. For example, the pad 140 may be formed on an entire lower surface of the supporting portion 124 including the first groove 1242, and may be electrically connected to the leading portion 132 of the coil 130. In addition, the pad 140 may be electrically connected to the board 110 using the conductive adhesive 170 (FIG. 3) such as a solder.

FIGS. 1 and 2 illustrate the pad 140 disposed only in the first groove 1242, but the configuration is not limited thereto. The pad 140 may also be disposed in the second groove 1244, as needed.

In addition, the present exemplary embodiment describes the case in which the pad 140 is formed by applying and plating the conductive material on the supporting portion 124 byway of example, but the configuration is not limited thereto. Various modifications of the formation of the pad 140 are possible. For example, metal flakes may be separately prepared and then attached or bonded to the supporting portion 124, thereby forming the pad 140.

The protective resin 150 may be disposed over the core 120 and the coil 130 (FIG. 3). For example, the protective resin 150 may cover one surface of the core 120 and a portion of the coil 130 as illustrated in FIG. 3. The protective resin 150 disposed as described above may insulate the coil 130 and protect the coil 130.

The protective resin 150 may be or include a photocurable material. For example, the protective resin 150 may include an epoxy resin. However, the material of the protective resin 150 is not limited to the epoxy resin. For example, the protective resin 150 may be or include a mixture of a ferrite powder having magnetism and a resin. In other embodiments, the protective resin 150 may be omitted.

Figure 4:
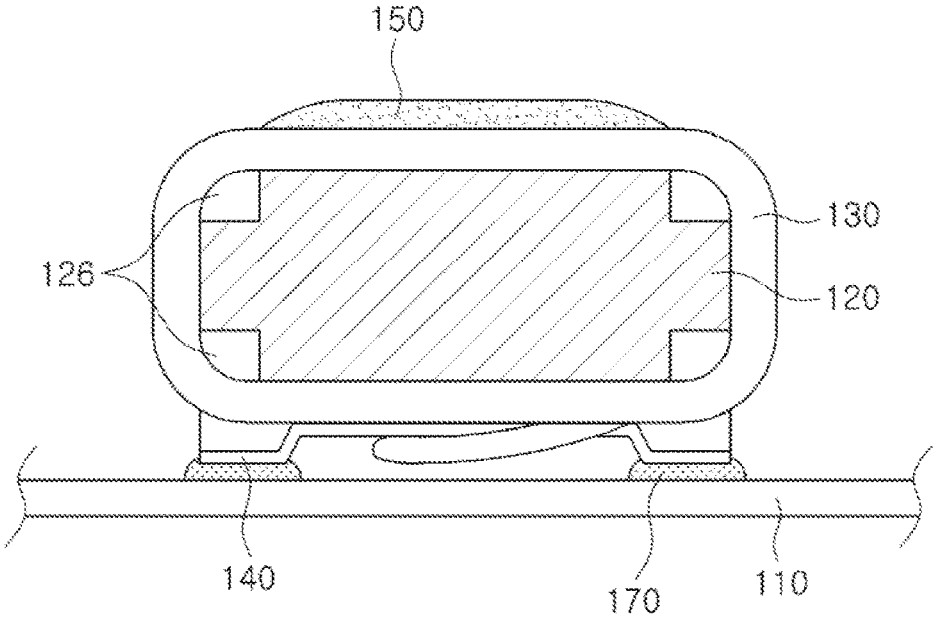
FIG. 4 is a cross-sectional view taken along a line I-I' of FIG. 3.
Figure 5:
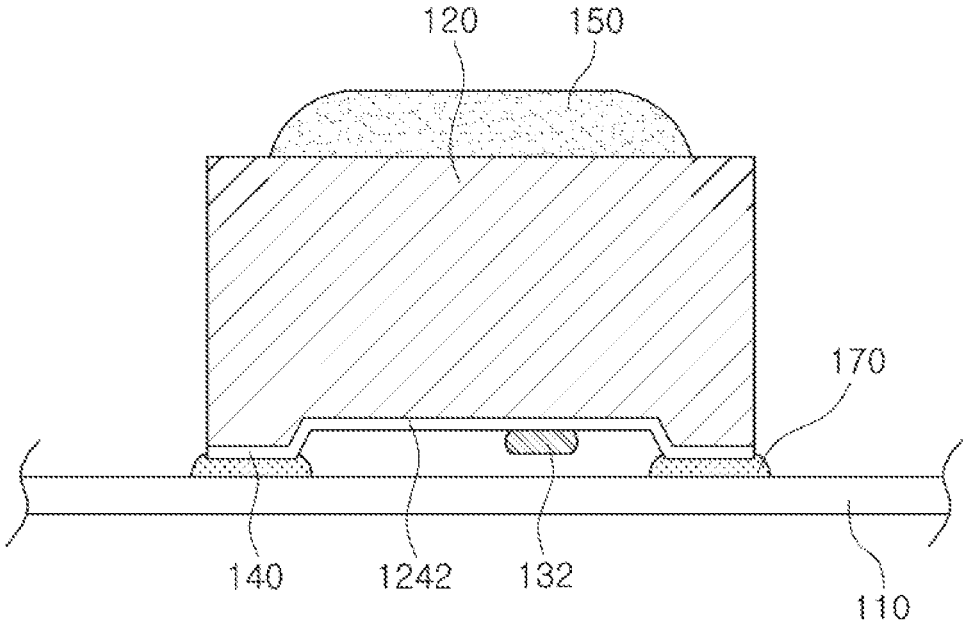
FIG. 5 is a cross-sectional view taken along a line II-II' of FIG. 3.
Figure 6:
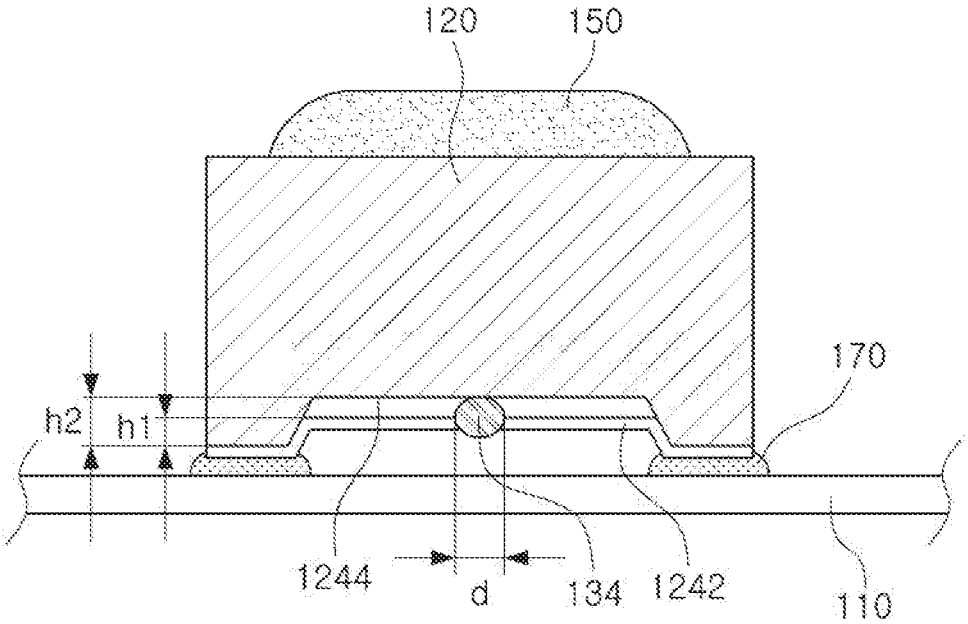
FIG. 6 is a cross-sectional view taken along a line III-III' of FIG. 3.

FIG. 4 is a cross-sectional view of the chip antenna 100 taken along a line I-I' of FIG. 3, FIG. 5 is a cross-sectional view of the chip antenna 100 taken along a line II-II' of FIG. 3, and FIG. 6 is a cross-sectional view of the chip antenna 100 taken along a line III-III' of FIG. 3.

The chip antenna 100 may be configured so that the coil 130 is wound around the core 120 with relative ease as illustrated in FIG. 4. The core 120 may have the chamfered edges 126 in a shape of a groove formed at the longitudinal edges of the body portion 122. If the chamfered edges 126 are omitted, the coil 130, when wound on the body portion 122, may be spaced from surfaces of the body portion 122 around the corners.

However, in the presence of the chamfered edges 126, the coil 130 may contact the surfaces of the body portion 122 around the corners of the body portion 122.

Therefore, a winding radius of the coil 130 may be significantly reduced by including the chamfered edges 126.

Further, since the chamfered edges 126 of the core 120 may provide an empty space between the core 120 and the coil 130, the chamfered edges 126 may also permit air flow in the spaces and thereby cool the core 120 and the coil 130.

The chip antenna 100 may be configured so that the board 110 and the core 120 may be coupled to each other as illustrated in FIG. 5. For example, the first groove 1242 may limit the leading portion 132 of the coil 130 from contacting the board 110.

As described above, the leading portion 132 of the coil 130 may be flattened (FIG. 5), and, as a result, the leading portion 132 may be positioned in the first groove 1242 and may be in surface contact with the pad 140.

As illustrated in FIG. 5, the conductive adhesive 170 is interposed between the pad 140 and the board 110. The conductive adhesive 170 may not be disposed in the first groove 1242 and may be disposed only between the legs 123 and the board 110. However, the configuration is not limited thereto. In other examples, the conductive adhesive 170 may be disposed in the first groove 1242. In this case, the leading portion 132 of the coil 130 may be electrically connected to the board 110 through the conductive adhesive 170.

The chip antenna 100 may be configured to accommodate the end 134 of the coil 130 as illustrated in FIG. 6. For example, the second groove 1244 may be formed in the core 120 such that the end 134 of the coil 130 may be contained therein. Thus, the extension of the end 134 beyond the second groove 1244 may be limited or otherwise minimized. Unlike the leading portion 132, the end 134 of the coil 130 may not be flattened. For example, the end 134 of the coil 130 may have a similar circular cross section as the coil 130, except the leading portion 132, as illustrated in FIG. 6. However, in other examples, the end 134 of the coil 130 may not have the same cross section as the coil 130. For example, the end 134 of the coil 130 may be plastic-deformed to have an oval cross section shape or other cross section shapes in a cutting operation or a bonding operation of the coil 130.

As illustrated in FIG. 6, a depth h1 of the first groove 1242 may be smaller than the diameter d of the coil 130, and a depth h2 of the second groove 1244 may be substantially the same as the diameter d of the coil 130 or may be greater than the diameter d of the coil 130.

Because the leading portion 132 of the coil 130 is disposed in the first groove 1242 of the core 120, a good bond between the board 110 and the core 120 may be obtained. In addition, since the chip antenna 100 has the portion 134 disposed in the second groove 1244 of the core 120, the end 134 of the coil 130 may not interfere when installing the coil antenna 100 on the board 110.

Hereinafter, a method for manufacturing a chip antenna according to the present exemplary embodiment will be briefly described.

Referring to FIG. 1, the method for manufacturing the chip antenna 100, according to the present exemplary embodiment, may include preparing the core 120 in which the first groove 1242 and the second groove 1244 are formed, and forming the pad 140 on the supporting portions 124 of the core 120. As described above, in a non-limiting example, the pad 140 may be completed by applying silver (Ag) paste to the core 120 to form a metal layer, and then forming a conductive layer on the metal layer.

Next, the coil 130 may be wound around the body portion 122 of the core 120, and the leading portion 132 of the coil 130 may be disposed in each pad 140. In this case, the leading portion 132 of the coil 130 may be positioned in the first groove 1242.

Next, the leading portion 132 may be flattened (or otherwise deformed) by a press-type apparatus 190 (FIG. 14), and the leading portion 132 may be bonded (e.g., welded, glued, or the like) to the pad 140 disposed on the first groove 1242.

Next, the end 134 of the coil 130 may be formed by cutting a distal portion of the coil 130 such that both ends 134 of the coil 130 may not extend beyond the longitudinal ends (X-direction) of the coil antenna 100 (or, more specifically, with the supporting portions 124). As a result, the end 134 of the coil 130 may not protrude from the core 120 (and thereby the chip antenna 100) and may be disposed in the second groove 1244.

The protective resin 150 may then be formed (or otherwise deposited) on the core 120 and the coil 130 of the chip antenna 100.

Figure 7:
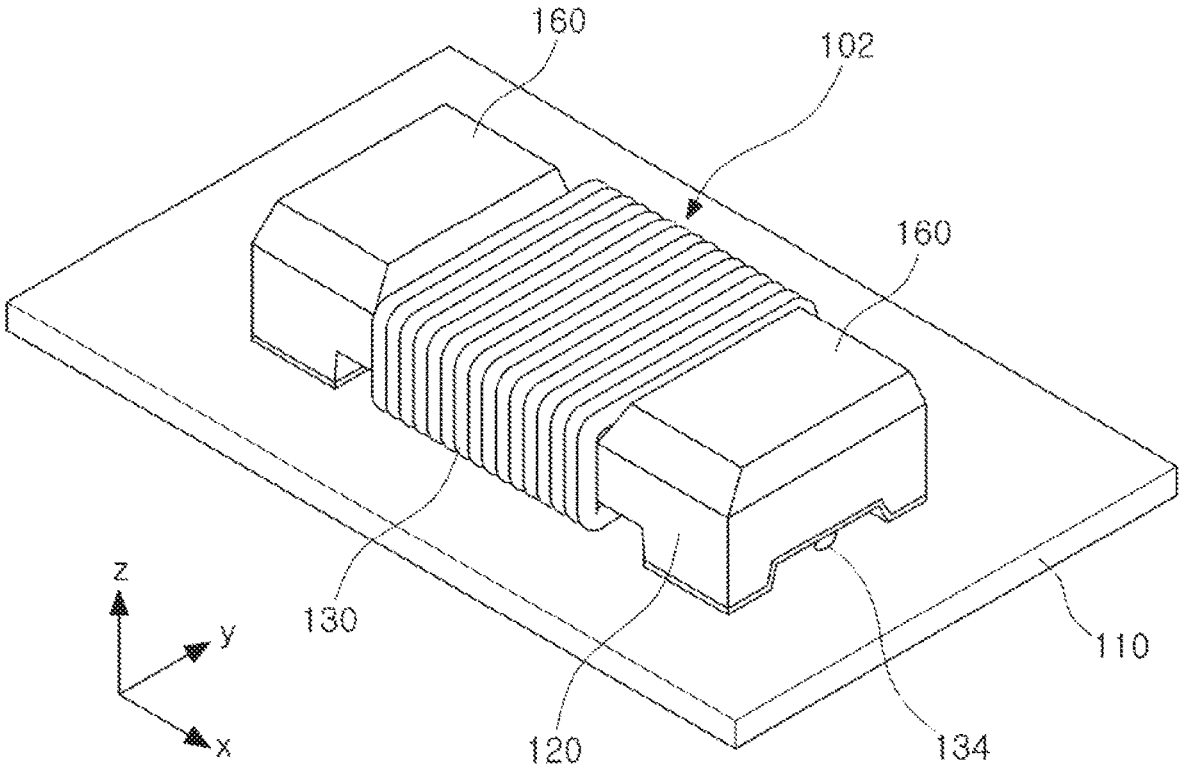
FIG. 7 is a perspective view of a chip antenna according to another exemplary embodiment in the present disclosure.

FIG. 7 is a perspective view of a chip antenna 102 according to another exemplary embodiment in the present disclosure. In the following description, the same components as those of the exemplary embodiment described above will be denoted by the same reference numerals as the exemplary embodiment described above, and a detailed description thereof will be omitted.

In the chip antenna 102, the core 120 may include guide blocks 160.

The guide blocks 160 may protrude from the surface of the core 120 opposite the surface from which the legs 123 protrude. For example, the guide blocks 160 may protrude from both longitudinally opposite ends of the core 120. The guide blocks 160 may limit the position of the coil 130 to the central portion of the core 120.

The characteristics of a chip antenna may vary when the position of the coil 130 changes on the core 120. Thus, it may be beneficial to maintain a position of the coil 130 on the core 120. During the manufacturing process, the position of the coil 130 may vary. The guide block 160 configured as described above may maintain the position of the coil 130 on the core 120 during manufacture and reliability of the manufacturing process may be improved.

In addition, since the guide block 160 may be used as a magnetic path of the core 120, it may increase transmission and reception efficiency of the chip antenna 102.

Figure 8:
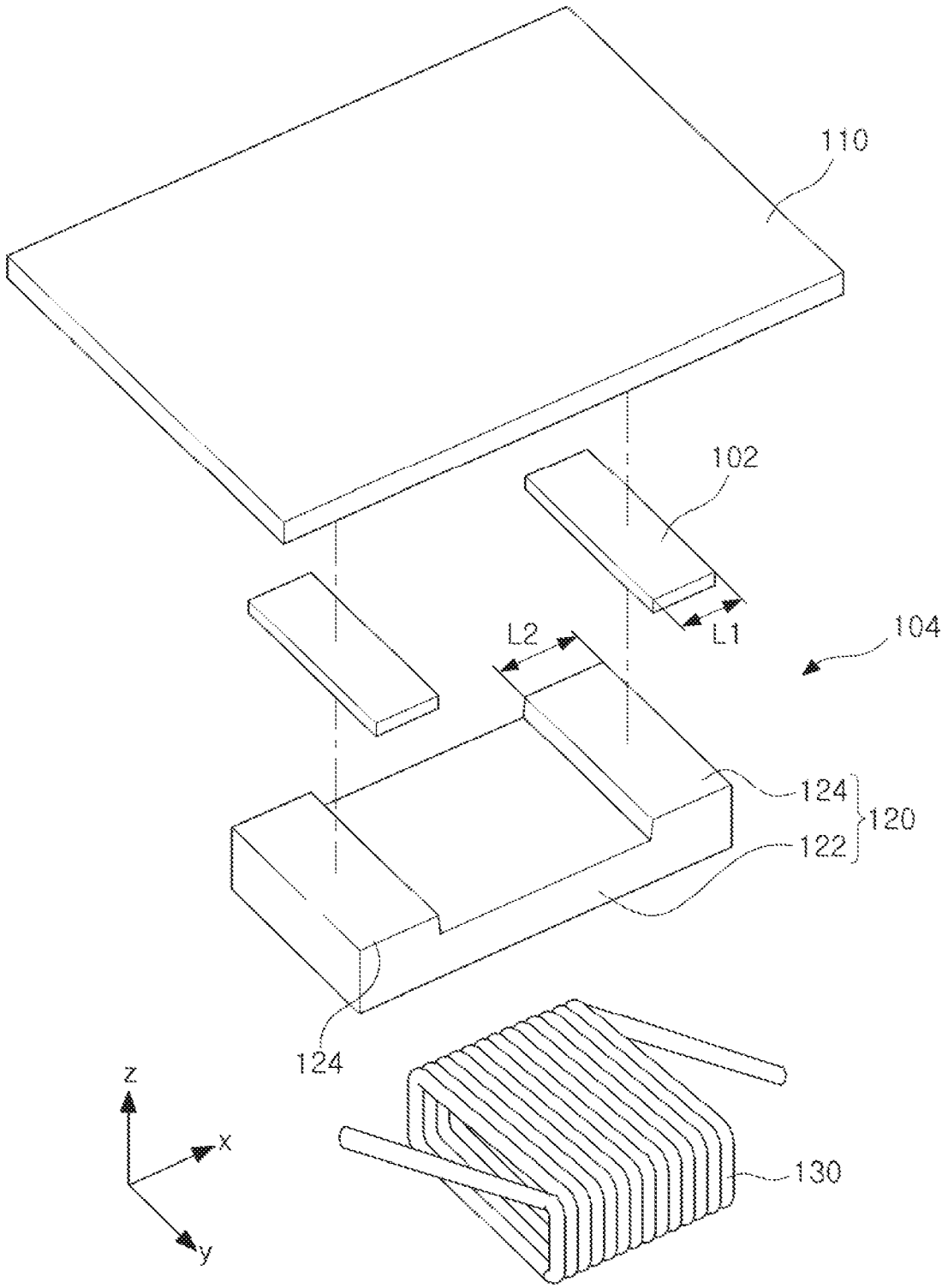
FIG. 8 is a perspective view of a chip antenna in an assembled state, according to another exemplary embodiment in the present disclosure.
Figure 9:
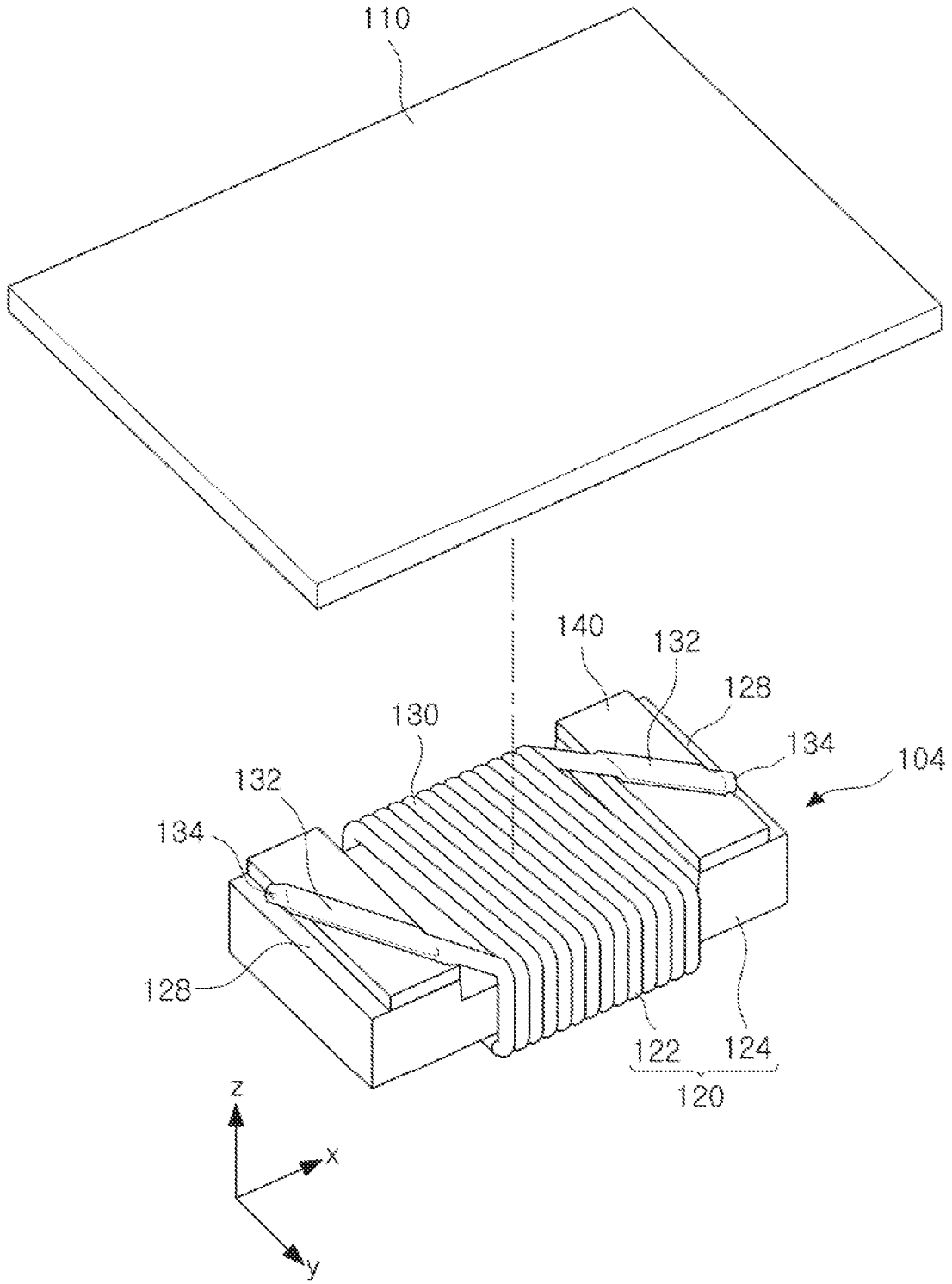
FIG. 9 is a perspective view of the chip antenna of FIG. 8 in a partially assembled state.
Figure 10:
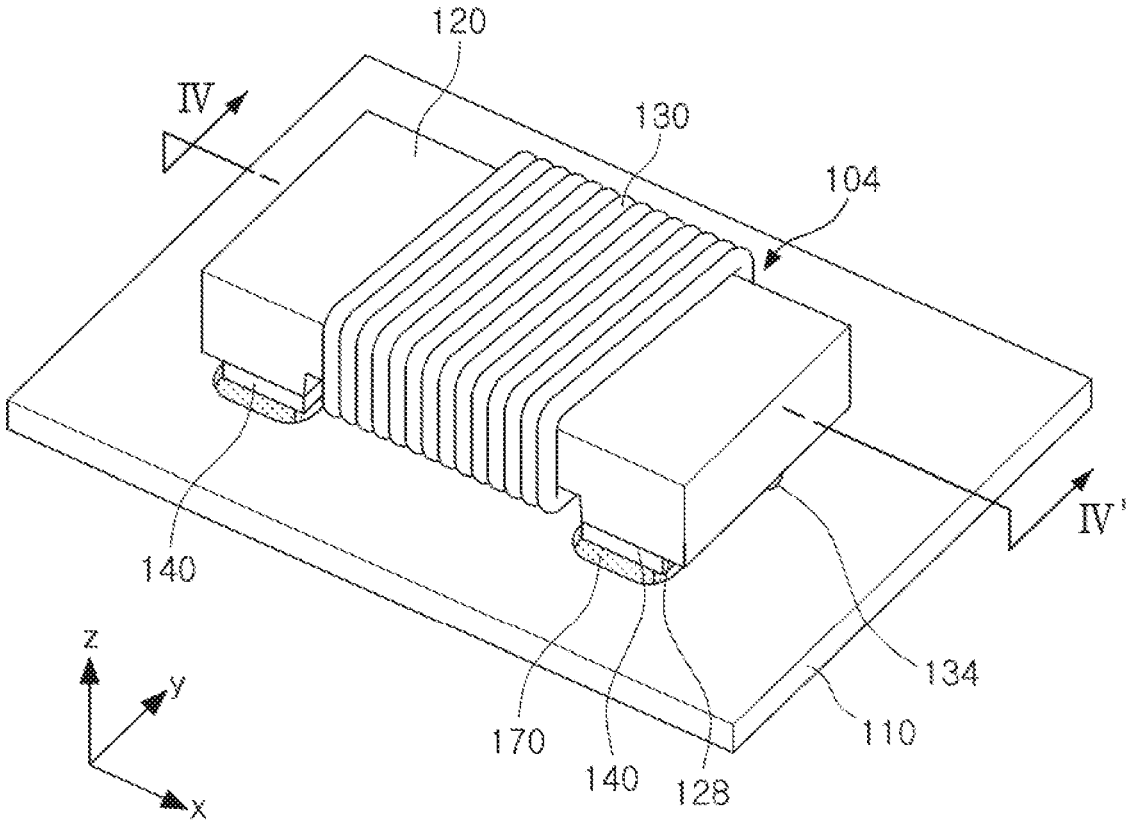
FIG. 10 is a perspective view of the chip antenna of FIG. 8 in an assembled state.
Figure 11:
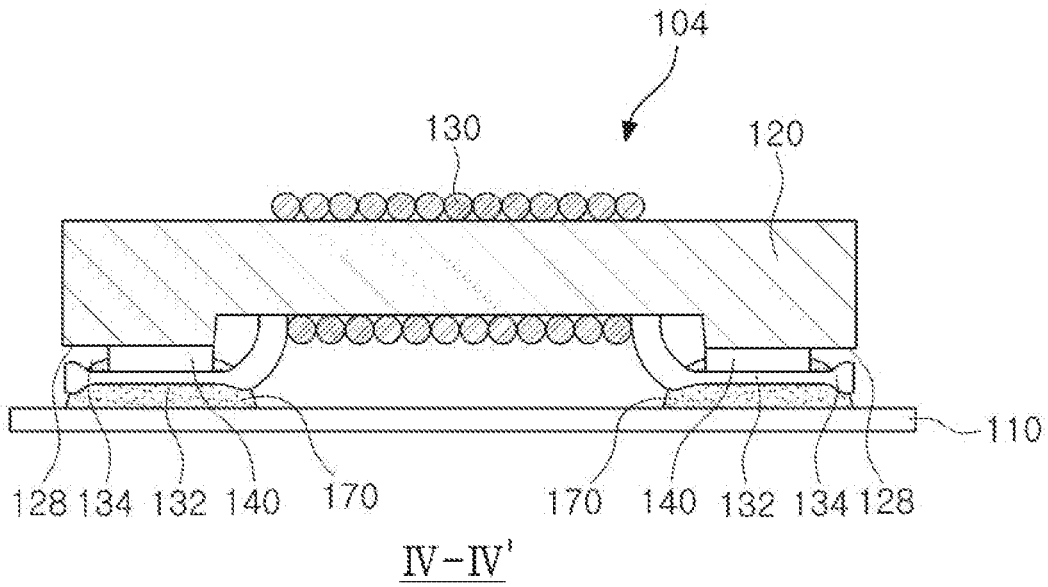
FIG. 11 is a cross-sectional view taken along a line IV-IV' of the chip antenna of FIG. 10.

FIG. 8 is a perspective view of a chip antenna 104 in an assembled state, according to another exemplary embodiment in the present disclosure. FIG. 9 is a perspective view of the chip antenna 104 in a partially assembled state. FIG. 10 is a perspective view of the chip antenna 104 in an assembled state. FIG. 11 is a cross-sectional view taken along a line IV-IV' of the chip antenna 104. The chip antenna 104 may be similar in some respects to the chip antennae 100 and 102 above, and therefore may be best understood with reference thereto where like numerals designate like components not described again in detail.

In the chip antenna 104, the first groove 1242 may be absent.

Also, in the chip antenna 104, the pad 140 may be in a shape of a flat plate having a predetermined thickness. The pad 140 may have an area smaller than the area of a bottom surface of the supporting portions 124 of the core 120. For example, a width L1 (X-direction) of the pad 140 may be substantially smaller than a width L2 (X-direction) of the supporting portions 124.

The pad 140 configured as described above may be disposed on the bottom surface of the supporting portions 124 of the core 120 as illustrated in FIG. 9 to form the second groove 128 (FIG. 9) at the longitudinally (X-direction) distal ends of the core 120.

More specifically, the second groove 128 may be defined as a space formed between the pad 140 and the supporting portion 124 due to area differences in the widths of each supporting portion 124 and the corresponding pad 140.

The second groove 128 may be used as the space in which the end 134 of the coil 130 is disposed as illustrated in FIGS. 9 and 10.

The pad 140 may have substantially the same thickness as the diameter of the coil 130, or may have a thickness greater than the diameter of the coil 130. Because of the thickness of the pad 140, the depth of the second groove 128 may permit the end 134 to be located therein.

A distance between the board 110 and the core 120 may be adjusted by the conductive adhesive 170 as illustrated in FIG. 11.

As described above, the chip antenna 100 according to the exemplary embodiments may bond the leading portion 132 to the pad 140 disposed on the first groove 1242 by positioning the leading portion 132 in the first groove 1242, flattening the leading portion 132, and then bonding the flattened leading portion 132 to the pad 140.

Therefore, only a region of the leading portion 132 may be flattened.

As illustrated in FIG. 2, the leading portion 132 may be bent at a corner M (e.g., an inner corner) of the first groove 1242. In this case, the press-type apparatus 190 for flattening the leading portion 132 may need to compress an entirety of the bent portion together so that an entire thickness of the leading portion 132 is deformed to be thinner than the depth of the first groove 1242 and the leading portion 132 does not protrude to the outside of the first groove 1242.

However, when the press-type apparatus 190 does not compress the entirety of the bent portion due to relative movement/motion of a product or tolerance of an equipment in the operation of compressing the leading portion 132, the portion which is not flattened may maintain its existing thickness, and the portion which is not flattened in the bent portion may protrude from the supporting portion 124 (more specifically, from the lower surface of the supporting portion 124).

In this case, the chip antenna 100 may be delaminated from the board 110 due to the protruding portion when mounted therein, and thereby causing a cold-solder joint.

Therefore, in some embodiments, the chip antenna according to the present disclosure may include a third groove.

Figure 12:
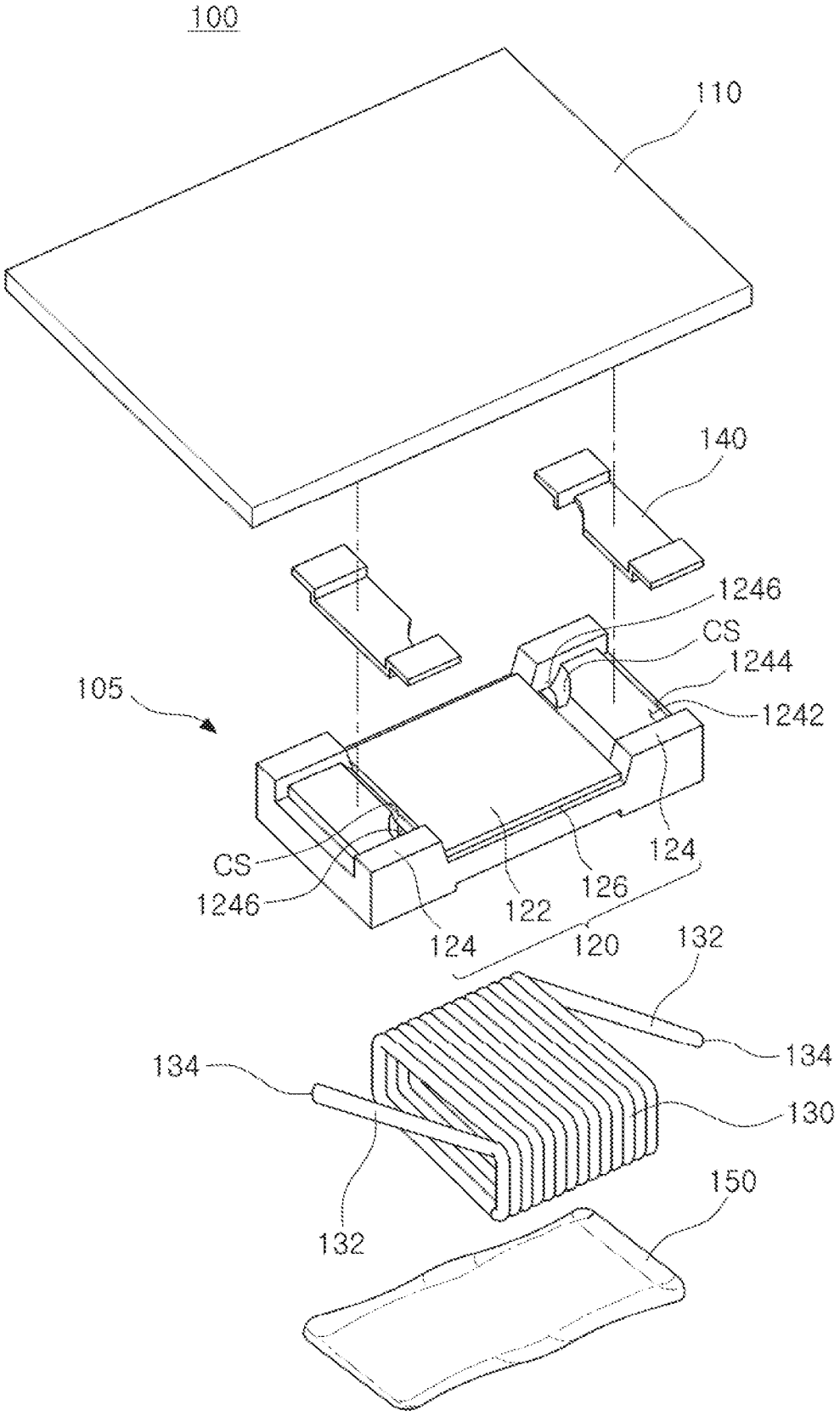
FIG. 12 is an exploded perspective view of a chip antenna according to another exemplary embodiment in the present disclosure.
Figure 13:
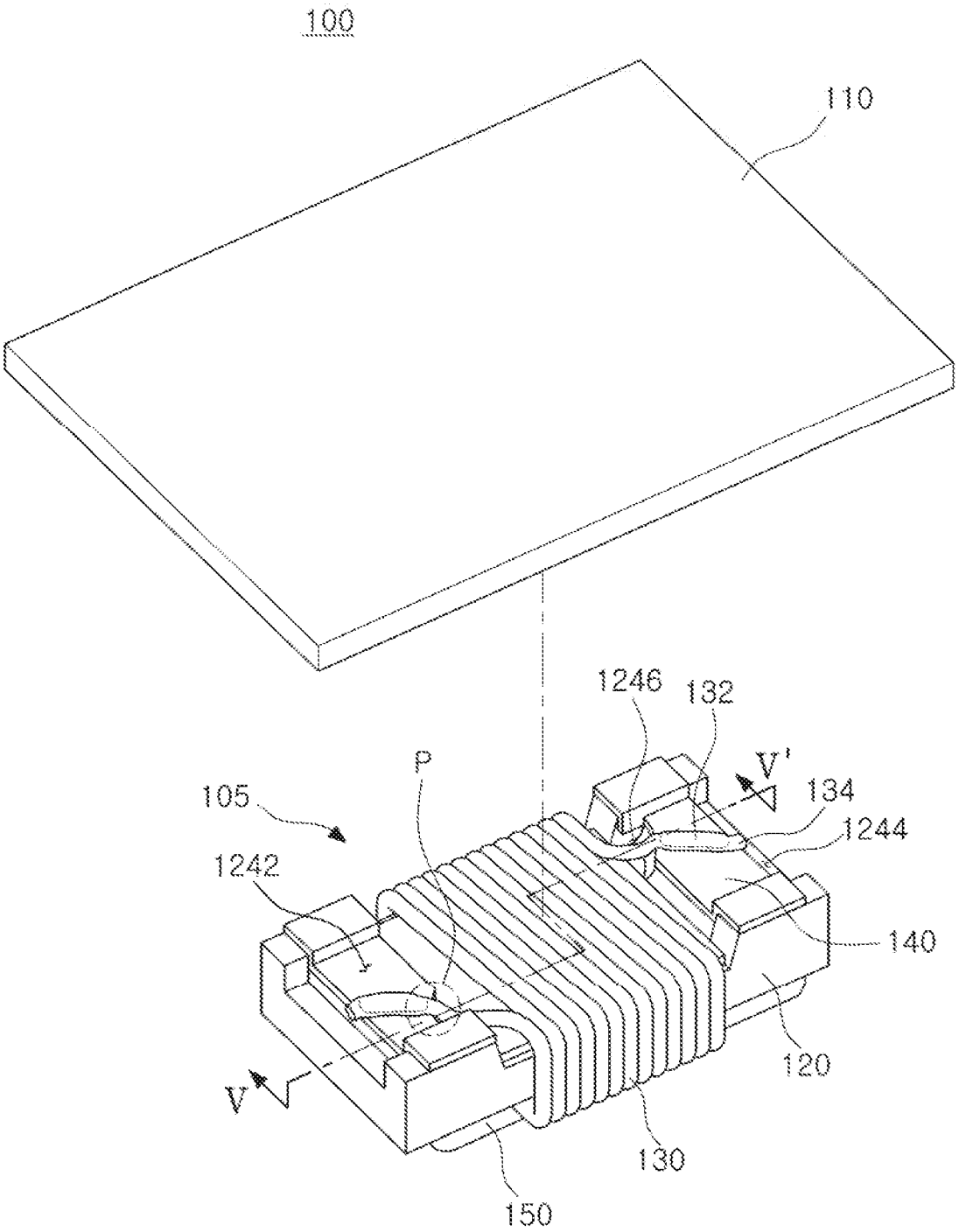
FIG. 13 is a perspective view of the chip antenna illustrated in FIG. 12.
Figure 14:
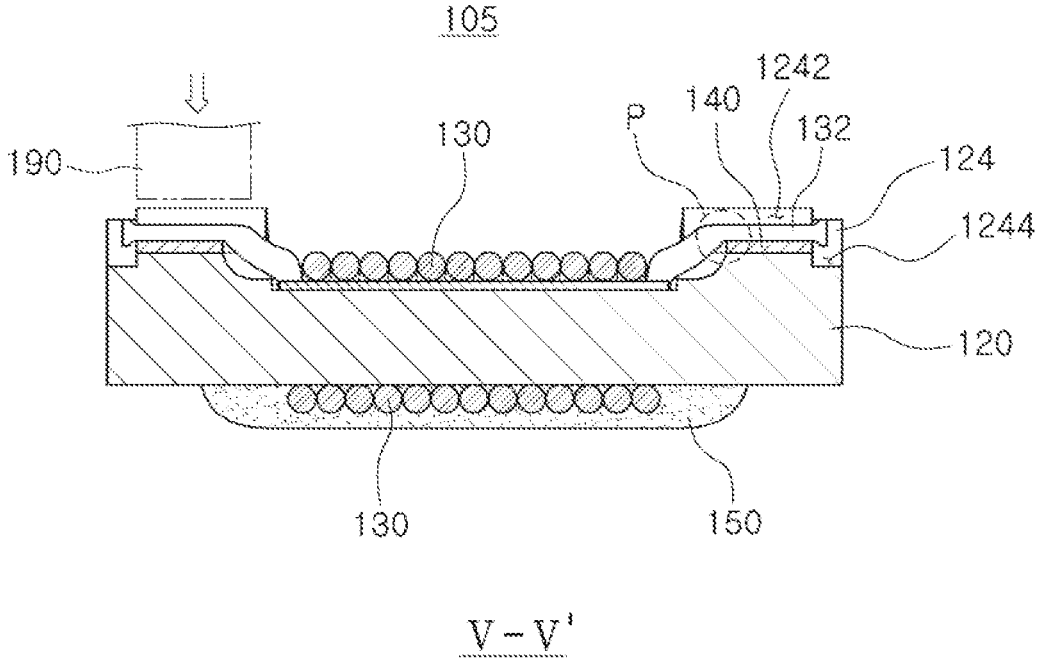
FIG. 14 is a cross-sectional view taken along a line V-V' of FIG. 13.
Figure 15:
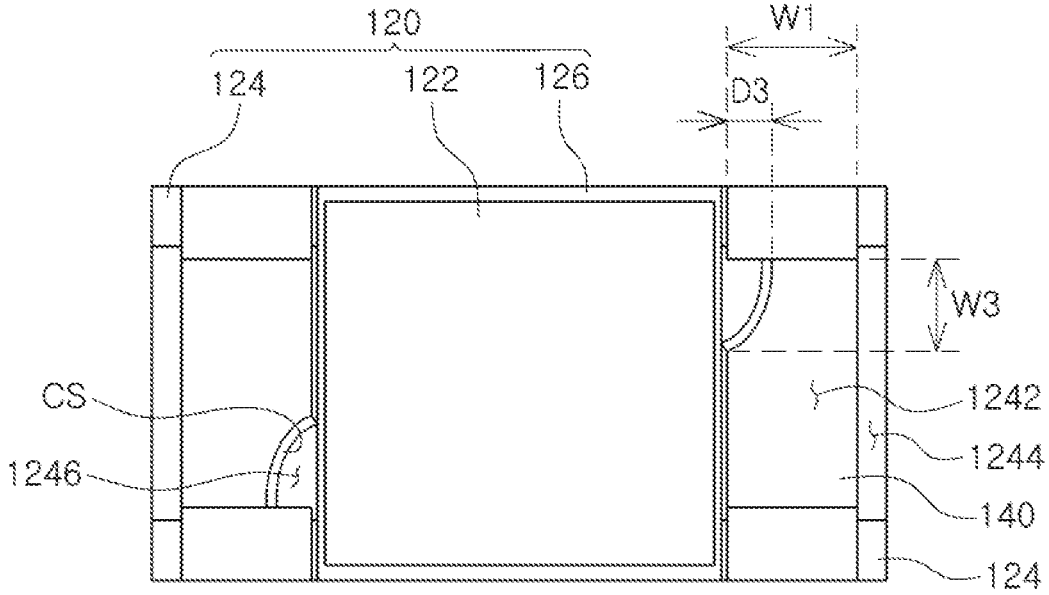
FIG. 15 is a bottom view of a core illustrated in FIG. 12.

FIG. 12 is a perspective view of a chip antenna 105 in an unassembled state, according to another exemplary embodiment in the present disclosure, FIG. 13 is a perspective view of the chip antenna 105 in a partially assembled state, and FIG. 14 is a cross-sectional view taken along a line V-V' of the chip antenna 105 of FIG. 12. FIG. 15 is a bottom view of the core 120 illustrated in FIG. 12, and illustrates the core 120 having the pad 140 bonded thereto. The chip antenna 105 may be similar in some respects to the chip antennae 100, 102, and 104 above, and therefore may be best understood with reference thereto where like numerals designate like components not described again in detail.

Referring to FIGS. 12 through 15, the chip antenna 105 may include a third groove 1246.

The third groove 1246 may be formed in a portion in which the leading portion 132 is drawn into the first groove 1242, and may reduce a width (e.g., L1 in FIG. 8) of the supporting portions 124.

Therefore, the third groove 1246 may be formed by partially removing the bottom surface of supporting portions 124 in the first groove 1242, and may be disposed at least partially along the leading portion 132. However, the third groove 1246 is not limited thereto, and the third groove 1246 may have different sizes, as required by application, design, and/or user preferences.

A width W3 (FIG. 15) of the third groove 1246 in a width direction of the core 120 may be greater than a width of the leading portion 132 so that the third groove 1246 may receive the leading portion 132. In addition, a width D3 (FIG. 15) of the third groove 1246 along a length direction of the core 120 may be ⅓ or more to ½ or less of the maximum width W1 of the first groove 1242. However, the configuration of the third groove 1246 is not limited thereto.

The third groove 1246 may be used as a passage in which the leading portion 132 of the coil 130 is drawn into the first groove 1242. Therefore, the third groove 1246 may be disposed in a direction opposite to the second groove 1244 with respect to the first groove 1242, and may be each formed in a portion in which the body portion 122 and the supporting portions 124 are connected to each other.

A surface CS of the third groove 1246 that is in contact with the bottom surface of the first groove 1242 may be an inclined surface or a curved surface so that the leading portion 132 is drawn into the first groove 1242.

As the third groove 1246 is provided, a portion of the leading portion 132 of the coil 130 may be disposed in the third groove 1246, and may be bent at a corner in which the third groove 1246 and the first groove 1242 are in contact with each other, such that the remaining portion of the leading portion 132 may be disposed in the first groove 1242. In addition, the end 130 of the coil may be disposed in the second groove 1244, as discussed above).

Accordingly, a portion P (FIG. 14) of the leading portion 132 which is bent in an operation in which the leading portion 132 is drawn into the first groove 1242 may be positioned in a region of the first groove 1242 (FIG. 1) (or a compressible region of the press-type apparatus) in the exemplary embodiment described above.

Therefore, even if the movement/deviation of the product or the tolerance of the equipment occurs during the operation of manufacturing the chip antenna, the entirety of the bent portion P may be stably compressed, whereby the protrusion of the portion of the leading portion 132 to the outside of the supporting portion 124 may be limited.

Meanwhile, although the present exemplary embodiment describes a case in which the first groove, the second groove, and the third groove are all provided by way of example, the first groove or the second groove may also be omitted, as needed. For example, only the third groove 128 and the second groove 1242 may also be formed in the supporting portion 124. In this case, the third groove 128 may be formed in a form of partially removing the bottom surface of the supporting portions 124, and the leading portion of the coil may be drawn into the bottom surface of the supporting portion 124, not the first groove 1242, along the third groove 128. In addition, the end portion of the coil 130 may be disposed in the second groove.

As set forth above, according to the exemplary embodiments in the present disclosure, since the end portion of the coil does not protrude to the lower portion of the chip antenna, a bond between the chip antenna and the main board may be improved. Since the insertion groove in which the end portion of the coil is disposed is formed in the diagonal shape depending on the winding direction of the coil, the end portion of the coil may be disposed in the insertion groove during manufacturing the chip antenna, whereby the chip antenna may be very easily manufactured.

In addition, even if the deviation of the product or the tolerance of the equipment occurs during manufacturing the chip antenna, the entirety of the bent portion may be flattened, whereby the protrusion of the portion of the coil to the outside may be limited.

While exemplary embodiments have been shown and described above, it will be apparent to those skilled in the art that modifications and variations could be made without departing from the scope of the present disclosure as defined by the appended claims.

What is claimed is:

1. A chip antenna comprising:

a coil;

a core including a body portion around which the coil is wound and supporting portions, each on one of opposite ends of the body portion, the core including a first groove in each supporting portion, the first groove being configured to receive an end of the coil; and a second groove in each supporting portion and adjacent the first groove, wherein a thickness of the supporting portions in the first groove is less than a thickness of the supporting portions in the second groove, wherein the second groove has a depth shallower than a diameter of the coil, and wherein a leading portion of the coil is flattened to be entirely inserted into the second groove.

2. The chip antenna of claim 1, wherein the first groove is at an outer distal end of the core.

3. The chip antenna of claim 2, further comprising:

a pad including at least a portion along a bottom surface of the second groove, and electrically connected to the coil.

4. The chip antenna of claim 3, wherein the leading portion is in the second groove and bonded to the pad.

5. The chip antenna of claim 1, further comprising:

a pad on a bottom surface of the supporting portions and electrically connected to the coil.

6. The chip antenna of claim 5, wherein the pad has an area smaller than an area of a bottom surface of a corresponding one of the supporting portions, and the first groove is in a boundary region between the pad and the supporting portions.

7. The chip antenna of claim 1, wherein the body portion has a substantially rectangular cross-sectional shape, and at least one chamfered edge is defined between the opposite ends of the core and along edges of the body portion.

8. The chip antenna of claim 2, wherein the first groove is deeper than the second groove.

9. The chip antenna of claim 1, further comprising:

a guide block on the core and configured to fix a winding position of the coil.

10. The chip antenna of claim 2, further comprising:

a third groove defined by a partially removed bottom surface of the first groove.

11. The chip antenna of claim 10, wherein a width of the third groove in a width direction of the core is greater than a width of the coil.

12. The chip antenna of claim 10, wherein one surface of the third groove in contact with a bottom surface of the first groove is an inclined surface or a curved surface.

13. The chip antenna of claim 10, wherein a width of the third groove according to a length direction of the core is in a range of ⅓ or more to ½ or less of a maximum width of the second groove.

14. A chip antenna comprising:

a core including a body portion around which the coil is wound and supporting portions on opposite ends of the body portion, the core including a first groove defined on a bottom surface of each supporting portion, a leading portion of the coil is received in the supporting portions through the first groove; and a second groove in a bottom surface of a corresponding one of the supporting portions, wherein a thickness of the supporting portions in the first groove is less than the thickness of the supporting portions in the second groove, wherein the second groove has a depth shallower than a diameter of the coil, and wherein the leading portion is flattened to be entirely inserted into the second groove.

15. The chip antenna of claim 14, wherein the leading portion is received via the first groove which is in the second groove.

* * * * *